US012557947B2

(12) United States Patent
Aslaksen

(10) Patent No.: US 12,557,947 B2
(45) Date of Patent: Feb. 24, 2026

(54) INCINERATION TOILET

(71) Applicant: Cinderella Technology AS, Midsund (NO)

(72) Inventor: Odd Arne Aslaksen, Furuflaten (NO)

(73) Assignee: Cinderella Technology AS, Midsund (NO)

( * ) Notice: Subject to any disclaimer, the term of this patent is extended or adjusted under 35 U.S.C. 154(b) by 213 days.

(21) Appl. No.: 18/286,974

(22) PCT Filed: Apr. 13, 2022

(86) PCT No.: PCT/EP2022/059832
§ 371 (c)(1),
(2) Date: Oct. 13, 2023

(87) PCT Pub. No.: WO2022/233551
PCT Pub. Date: Nov. 10, 2022

(65) Prior Publication Data

US 2024/0188767 A1 Jun. 13, 2024

(30) Foreign Application Priority Data

May 3, 2021 (NO) ..... 20210551

(51) Int. Cl.
*A47K 11/02* (2006.01)

(52) U.S. Cl.
CPC ..... *A47K 11/02* (2013.01)

(58) Field of Classification Search
CPC ..... A47K 11/02
See application file for complete search history.

(56) References Cited

U.S. PATENT DOCUMENTS 3,885,254 A * 5/1975 West ..... A47K 11/023 4/111.3
4,138,331 A 2/1979 Frankel et al.
5,337,422 A 8/1994 Blankenship

FOREIGN PATENT DOCUMENTS

EP 2561782 A1 * 2/2013 ..... F23G 5/00
JP H07-265230 A 10/1995
WO 2014/038957 A1 3/2014

OTHER PUBLICATIONS

International Search Report issued in PCT/EP2022/059832 on Jul. 25, 2022 (4 pages).

(Continued)

*Primary Examiner* — Janie M Loeppke
(74) *Attorney, Agent, or Firm* — Osha Bergman Watanabe & Burton LLP

(57) ABSTRACT

An incineration toilet includes a base, a toilet unit, and a toilet casing. The toilet unit is secured above the base. The toilet unit includes a toilet bowl, an incineration chamber formed by an upper incineration chamber section, and a removable ash tray positioned below the incineration chamber section. A lower surface of the incineration chamber section is provided in contact with an upper surface of the ash tray during an incineration process. The toilet casing is connected to the base for protecting an outside of the toilet casing against heat from the incineration chamber. The incineration toilet includes a closable access opening through which access is provided to the inside of the incineration toilet. The incineration toilet includes an ash tray supporting assembly for supporting the ash tray relative to the base. The ash tray supporting assembly includes an actuating element vertically movable between a first position and a second position. The upper surface of the ash tray is pushed upwardly towards the lower surface of the incinera- (Continued)

tion chamber section when the actuating element is in the second position.

11 Claims, 6 Drawing Sheets

(56) References Cited

OTHER PUBLICATIONS

Written Opinion of the International Searching Authority issued in PCT/EP2022/059832 on Jul. 25, 2022 (8 pages).
Norwegian Search Report issued in NO 20210551 mailed on Nov. 24, 2021 (2 pages).

* cited by examiner

INCINERATION TOILET

FIELD OF THE INVENTION

The present invention relates to an incinerating toilet.

BACKGROUND OF THE INVENTION

Different types of incinerating toilets exist. One type of incineration toilet comprises a base, a toilet unit secured above the base and a toilet casing connected to the base for protecting an outside of the toilet casing against heat from the toilet unit. In addition, the toilet casing provides a better esthetic appearance of the toilet.

The toilet unit comprises a toilet bowl, an incineration chamber formed by an upper incineration chamber section and a removable ash tray positioned below the incineration chamber section; wherein a lower surface of the incineration chamber section is provided in contact with an upper surface of the ash tray during an incineration process.

The incineration toilet comprises a closable access opening through which access is provided to the inside of the incineration toilet. In particular, the access opening is used to retrieve the ash tray in order to empty the ash tray.

In prior art, the ash tray is accurately adapted to its position between the base and the incineration chamber section. When the ash tray has normal room temperature, the ash tray can be retrieved relatively easy out from toilet. However, when the ash tray is heated due to the incineration process and a while after the incineration has stopped, the ash tray has expanded due to the temperature increase, and it may be difficult to retrieve as it is clamped between the base and the incineration chamber section. This is positive for safety reasons, as the ash tray cannot be retrieved when hot. However, this requires relatively small tolerances during manufacturing, and there is a risk of air leakages at the interface between the ash tray and the incineration chamber section.

One object of the present invention is to improve the incineration process and to increase safety of the incinerating toilet. One object is also to achieve an incineration toilet which is simple in use.

SUMMARY OF THE INVENTION

The present invention relates to an incineration toilet comprising:

a base;

a toilet unit secured above the base, wherein the toilet unit comprises a toilet bowl, an incineration chamber formed by an upper incineration chamber section and a removable ash tray positioned below the incineration chamber section; wherein a lower surface of the incineration chamber section is provided in contact with an upper surface of the ash tray during an incineration process;

a toilet casing connected to the base for protecting an outside of the toilet casing against heat from the incineration chamber;

wherein the incineration toilet comprises a closable access opening through which access is provided to the inside of the incineration toilet;

characterized in that the incineration toilet comprises an ash tray supporting assembly for supporting the ash tray relative to the base;

wherein the ash tray supporting assembly comprises:

an actuating element vertically movable between a first position and a second position, wherein the upper surface of the ash tray is pushed upwardly towards the lower surface of the incineration chamber section when the actuating element is in the second position.

In one aspect, the ash tray supporting assembly comprises a guiding support for positioning the ash tray above the actuating element, and wherein the actuating element is moving vertically through an aperture in the guiding support between the first position and the second position.

In one aspect, the ash tray is resting entirely on the guiding support when the actuating element is in the first position.

In one aspect, the ash tray is movable out from and into the closable access opening while the actuating element is in the first position.

The ash tray is movable out from and into the closable access opening along a central axis between a front side and a rear side of the incineration toilet. The ash tray is movable out from and into the closable access opening in a horizontal plane.

In one aspect, the ash tray is locked in position within the toilet unit by the actuating element when the actuating element is in the second position.

When the ash tray is locked in position within the incineration toilet, movement of the ash tray out from the incineration toilet is prevented.

In one aspect, the ash tray supporting assembly comprises a first, elastic element for connecting the actuating element relative to the guiding support.

In one aspect, the first elastic element is oriented along a central axis between a front side and a rear side of the incineration toilet.

In one aspect, the first, elastic element is a plate spring biased to hold the actuating element in the first position.

In one aspect, the ash tray supporting assembly comprises a operating mechanism insertable into and retrievable from the underside of the first, elastic element, wherein the first elastic element is forced upwardly when the operating mechanism is inserted into the underside of the first, elastic element and wherein the first elastic element is allowed to retract downwardly when the operating mechanism is retrieved from the underside of the first, elastic element.

In one aspect, the operating mechanism comprises a handle in one end thereof.

In one aspect, the handle is accessible through the closable access opening.

In one aspect, the operating mechanism comprises cross members and a second, elastic element biased to push the first elastic element upwardly when the operating mechanism is inserted into the underside of the first, elastic element.

In one aspect, the second, elastic element is a plate spring, applying a constant upwardly directed force to the underside of the first, elastic element and hence to the underside of the actuating element.

In one aspect, the second, elastic element has a spring constant larger than a spring constant of the first, elastic element.

In one aspect, a downwardly facing surface of the ash tray comprises a central opening adapted to receive the actuating element.

In one aspect, the actuating element is vertically movable a first distance between its first position and its second position, wherein the upper surface of the ash tray is pushed upwardly a second distance when the actuating element is in the second position, wherein the first distance is larger than the second distance.

According to the above, it is achieved that the ash tray is pressed up towards the upper incineration chamber section when the actuating element is in its first position, thereby preventing or at least reducing gaps between the ash tray and the upper incineration chamber section. This will improve the incineration process as air leaks will prevented or reduced. Hence, air supply to the incineration process is controlled by the ventilation system of the incineration toilet alone. This will also reduce or prevent leakage of waste gas to the surroundings of the toilet.

In addition, it is achieved that the ash tray is simpler to retrieve when the actuating element is in the second position, making the incineration toilet simpler to use.

OVERVIEW OF DRAWINGS

Figure 4:
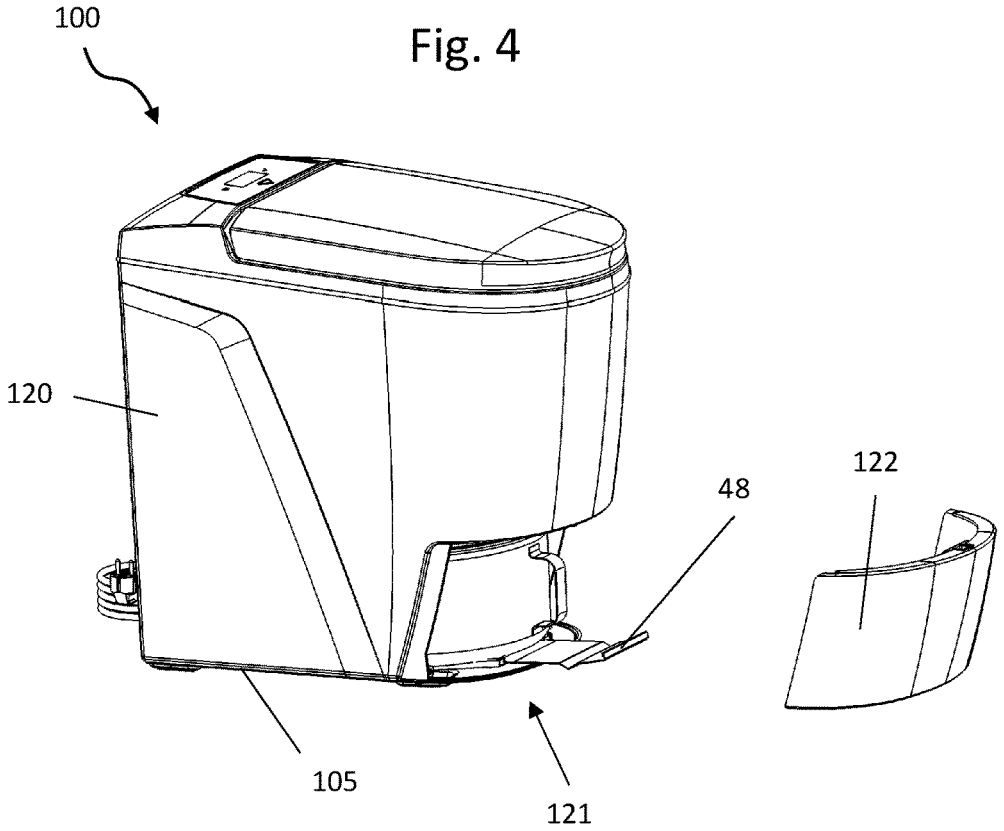
Figure 5:
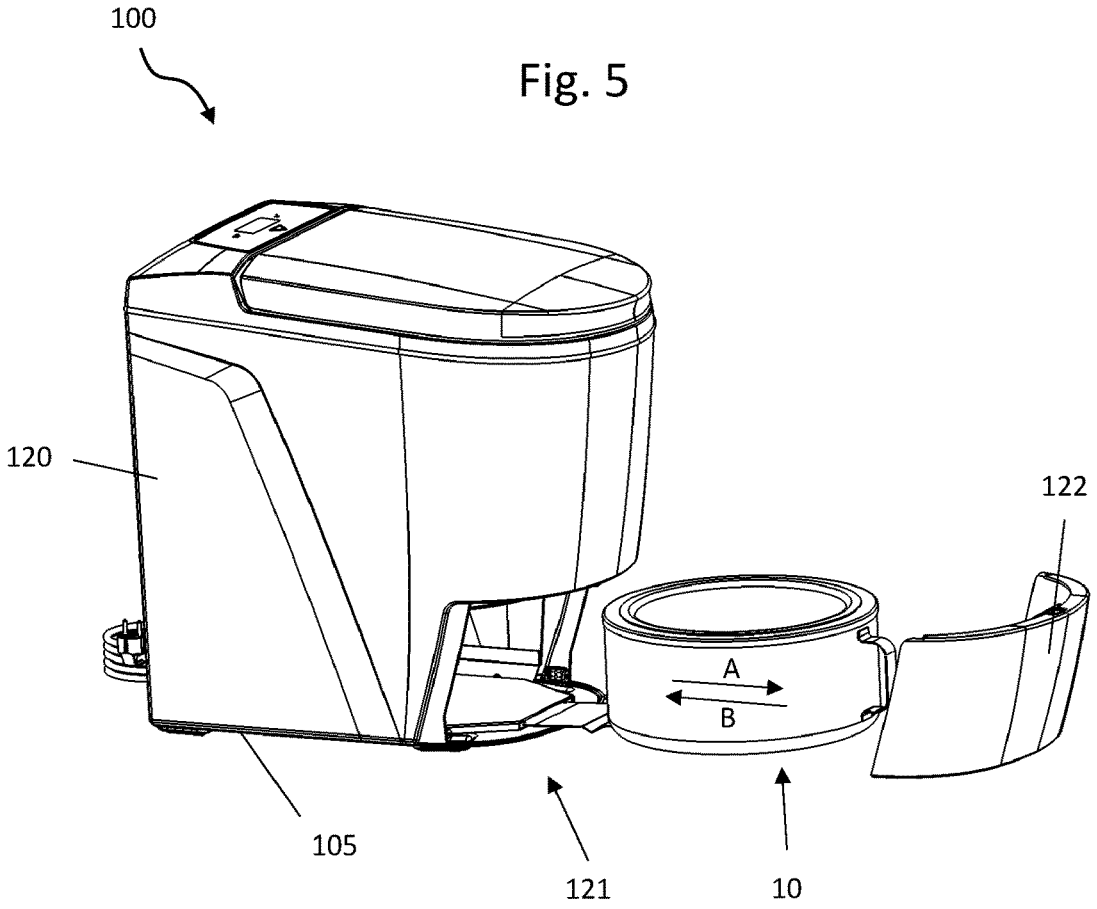
Figure 6:
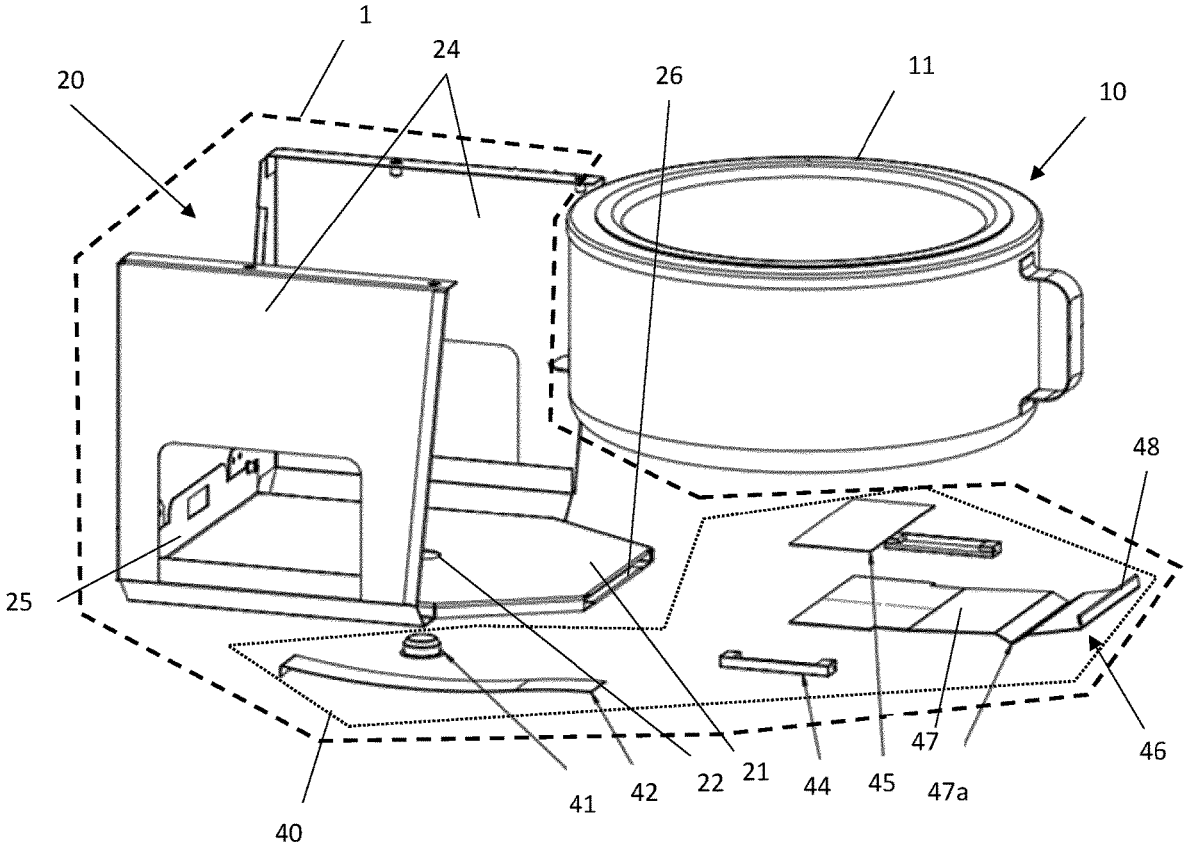
Figure 7:
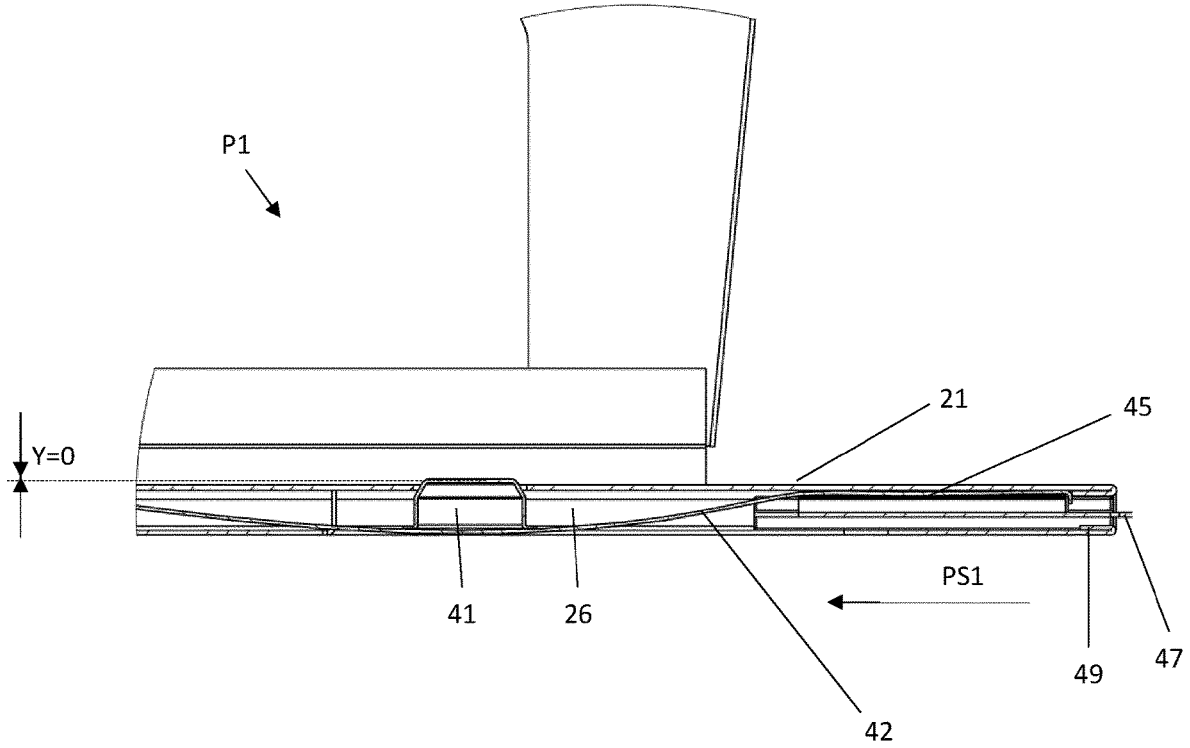

FIG. 4 shows a perspective view of the incineration toilet with opening hatch removed and handle of actuator pulled out FIG. 5 shows a perspective view of the incineration toilet with the ash tray removed FIG. 6 shows an exploded view of the ash tray support assembly with ash tray and actuator assembly FIG. 7 shows a cross-sectional view of the mechanism to move the actuating element in the open position (P1).

Figure 8:
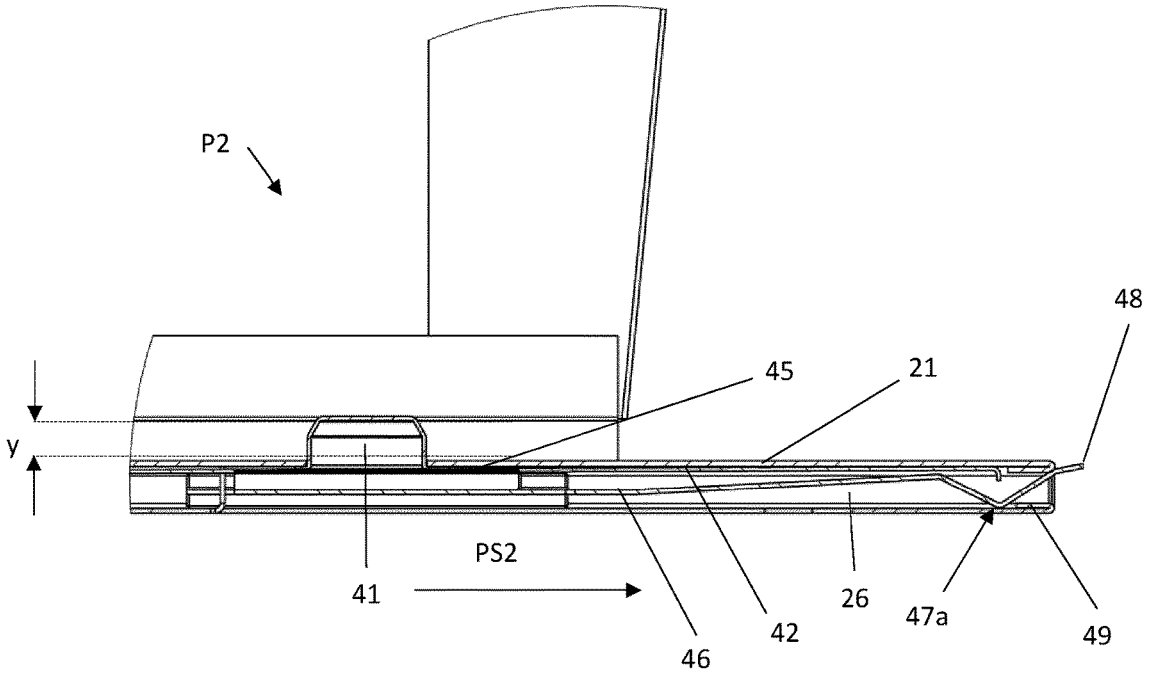

FIG. 8 shows a cross-sectional view of the mechanism to move the actuating element in the closed position (P2).

Figure 9:
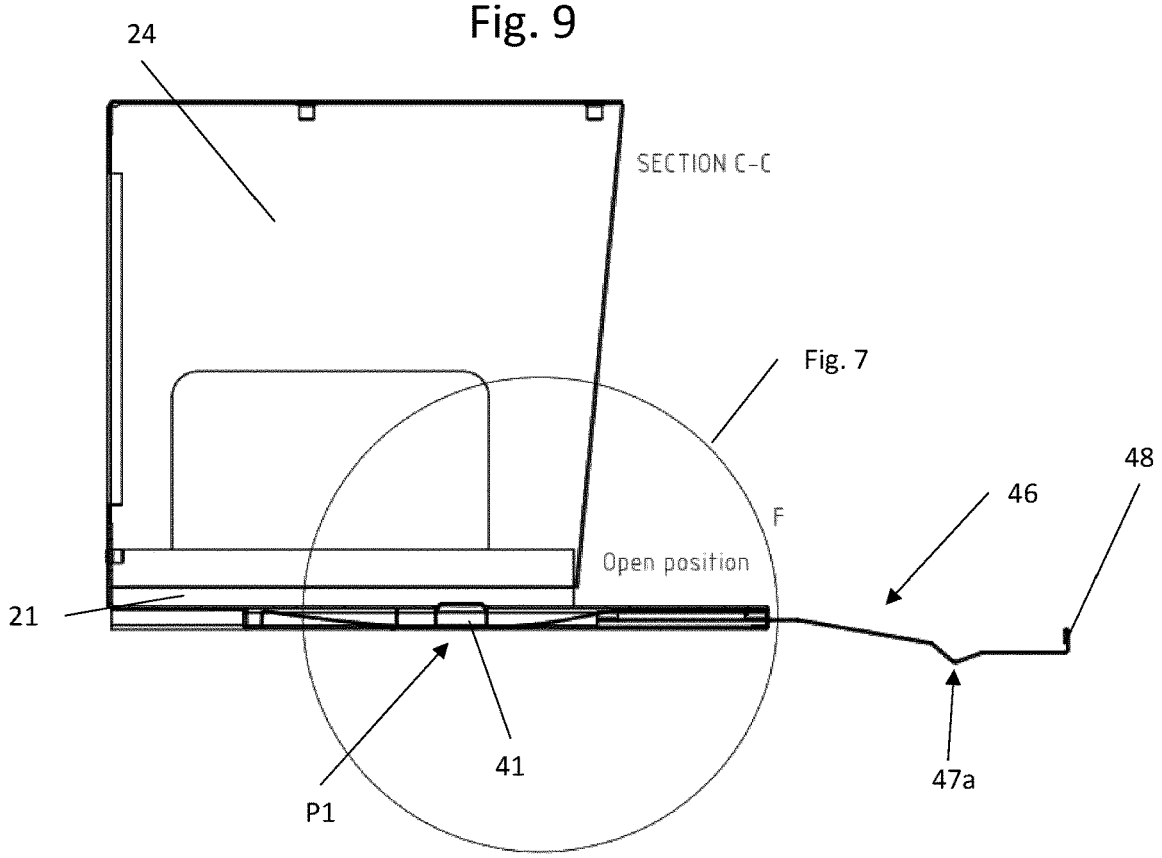

FIG. 9 shows a cross-sectional view of the position of the handle in relation to the actuating element (open position P1).

Figure 10:
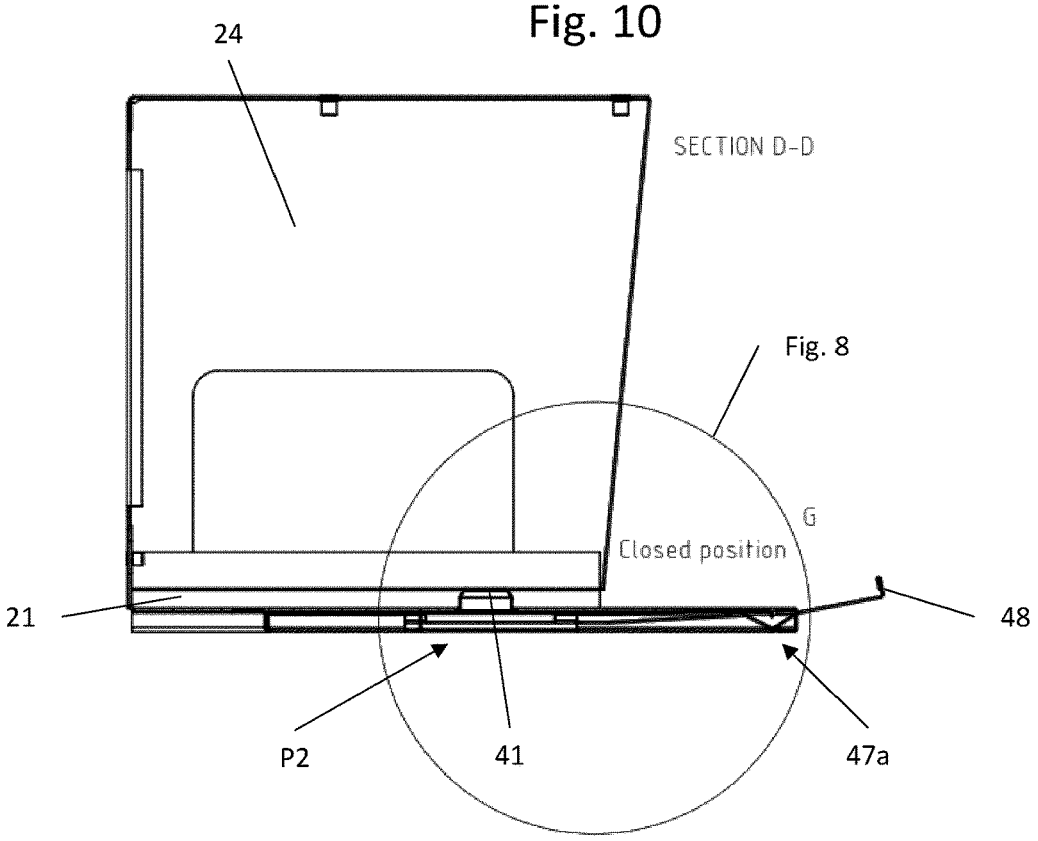

FIG. 10 shows a cross-sectional view of the position of the handle in relation to the actuating element (closed position P2).

DETAILED DESCRIPTION

Figure 1:
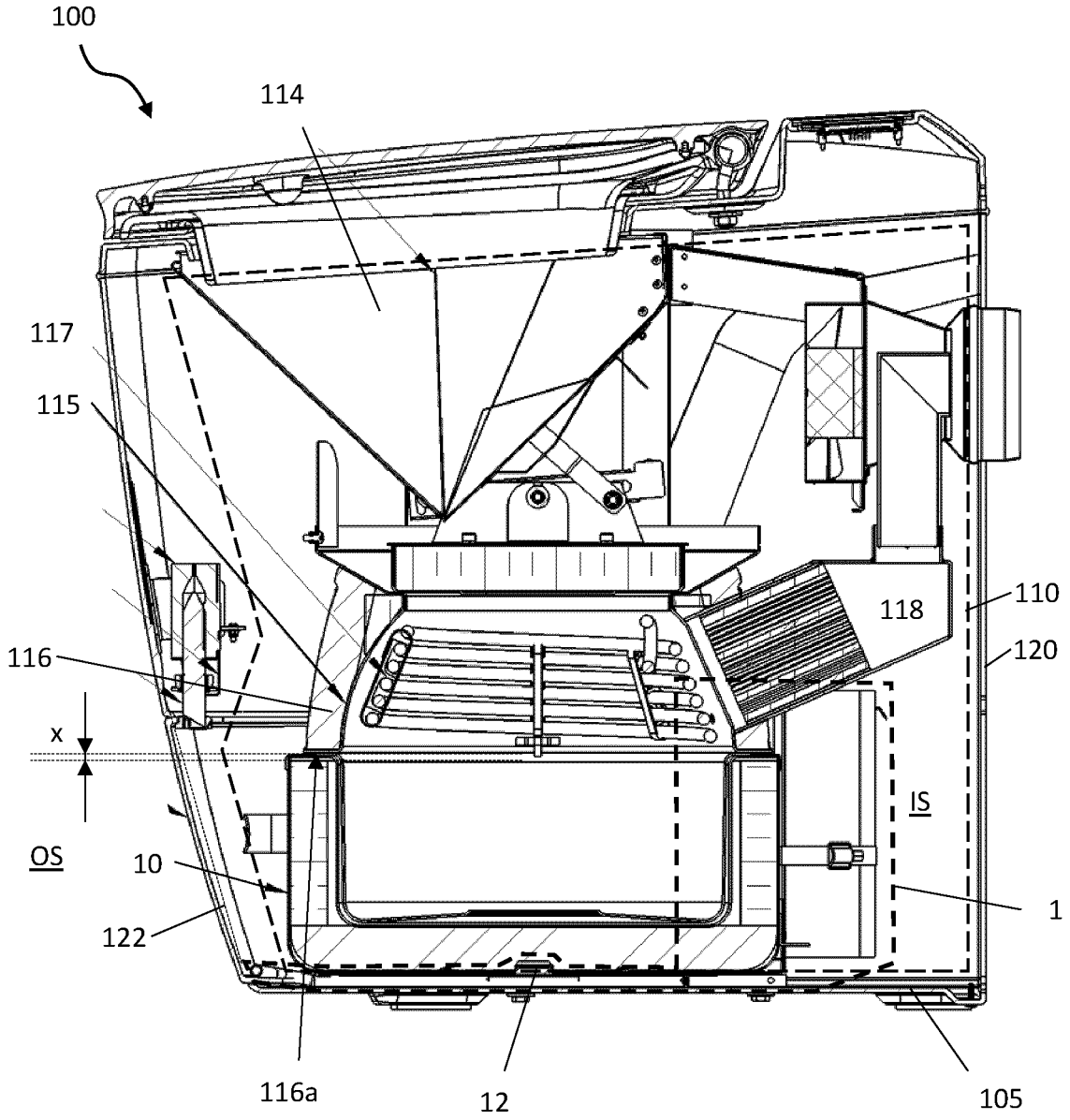
FIG. 1 shows a cross-sectional side view of the incineration toilet.

FIG. 1 shows an incineration toilet 100 comprising a base 105 and a toilet unit 110 secured above the base 105. A toilet casing 120 is connected to the base 105. The toilet unit 110 is located inside of the toilet casing 120, and the toilet unit 110 is indicated with a dashed line. The main parts of the toilet unit 110 are a toilet bowl 114, an incineration chamber 115 and an ash tray 10. The ash tray 10 may form the lower part of the incineration chamber 115. The lower surface 116*a* of the incineration chamber section 116 is in close contact with the upper surface 11 of the ash tray 10 during the incineration process.

The toilet unit 110 further comprises a heater element indicated as 117. In FIG. 1, the heater element 117 is an electric heater supplied with electric energy for heating the incineration chamber 115. Alternatively, the heater element 117 may be a gas heater supplied with a combustible gas such as propane. Other energy sources may also be possible.

In addition, the toilet unit 110 comprises a ventilation system generally indicated as 118, comprising a fan and ventilation ducts for supplying the incineration chamber 115 with air and for removing waste gas from the incineration process.

Figure 3:
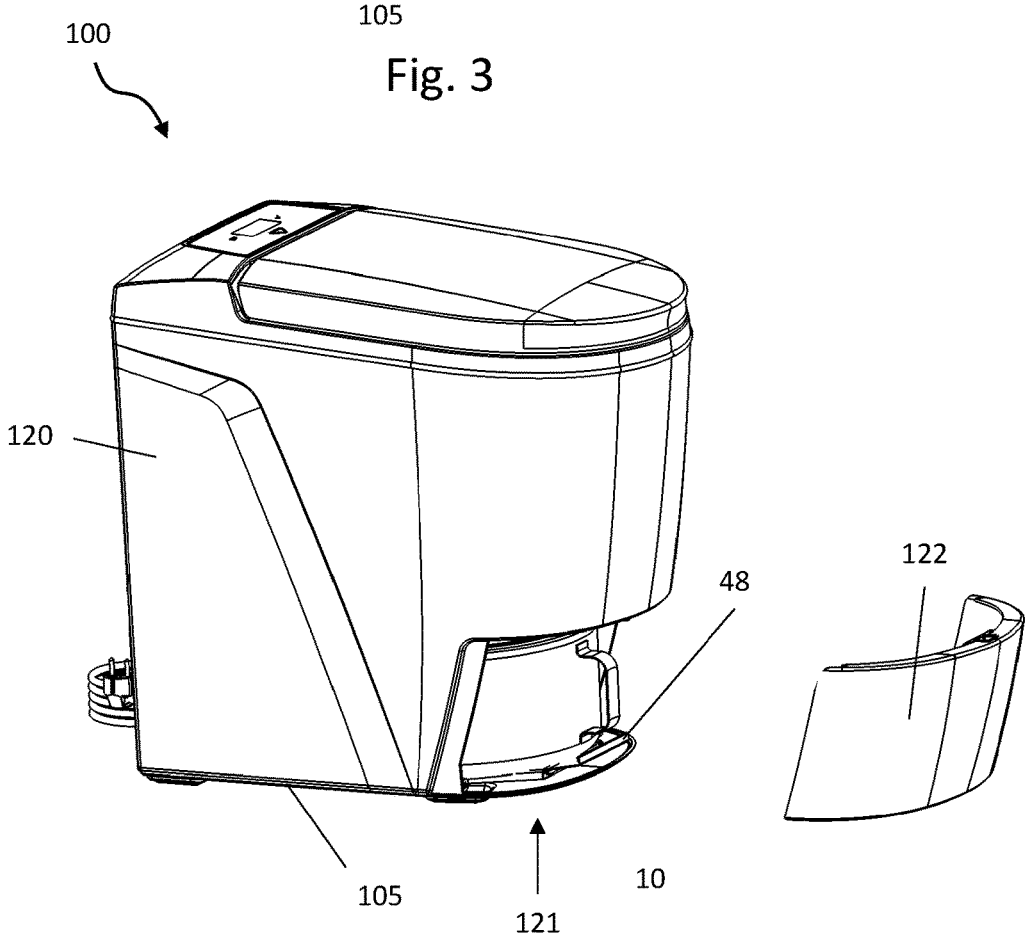
FIG. 3 shows a perspective view of the incineration toilet with opening hatch removed.

The toilet casing 120 protects an outside OS of the toilet casing 120 against heat from the incineration chamber 115. FIG. 3 shows that the casing 120 also contains a removable lid 122 to provide access to the inside IS of the incineration toilet 100 through the closable access opening 121.

The toilet bowl 114, the incineration chamber 115, the ash tray 10, the heater element 117 and the ventilation system 118 are considered known from prior art incineration toilets and will not be described in detail herein. The focus will be on how to reduce air leaks to improve control of the combustion process as the air supply to the combustion process is controlled by the ventilation system alone and which reduces risk of leak of waste gas to the surroundings of the toilet.

Ashtray Support Assembly and Actuating Mechanism

As shown in FIG. 1, the incineration toilet 100 comprises an ash tray supporting assembly indicated as a dashed area 1 for supporting the ash tray 10 relative to the base 105.

FIG. 6 shows a detailed view of the ashtray supporting assembly 1. The ashtray supporting assembly 1 comprises a guiding frame 20 comprising a base panel 21, a side panels 24, a hollow space 26 below the base panel 21 and a back panel 25. The base plate 21 has an aperture 22 between the hollow space 26 below the base panel 21 for an actuating element 41, which will be described further in detail below. The base panel 21, the side panels 24 and the back panel 25 defines a location for the ashtray 10. When the ash tray 10 is removed from the incineration toilet 100 by moving it in direction B through the closable access opening 122, it is guided by the side panels 24. When the ash tray 10 is placed inside the incineration toilet 100 by moving it in the direction A through the closable access opening 122, it is guided by the side panels 24 until it stops against the back panel 25. Hence, the guiding frame 20 positions the ash tray 10 above the aperture 22 and hence the actuating element 41.

FIG. 6, FIG. 7 and FIG. 8 show that the actuating element 41 is moving vertically through the aperture 22 in the base panel 21 between a first position P1 and a second position P2. The ash tray 10 is resting entirely on the base panel 21 when the actuating element 41 is in the first position P1. The purpose of the actuating element 41 is to push the upper surface 11 of the ash tray 10 upwardly towards the lower surface 116*a* of the incineration chamber section 116 when the actuating element 41 is in the second position P2.

Furthermore, FIGS. 7 and 8 show that the actuating element 41 is vertically movable a first distance (y) between its first position P1 and its second position P2. Moreover, the upper surface 11 of the ash tray 10 is pushed upwardly a second distance (x), as shown in FIG. 1, when the actuating element 41 is in the second position P2. As indicating in the drawings, the first distance (y) is larger than the second distance (x).

Also shown in FIG. 6 is that the ashtray supporting assembly 1 comprises an actuating mechanism 40 for moving the actuating element 41 between the abovementioned first position P1 and second position P2. The actuating mechanism 40 comprises a first elastic element 42, where at least one end of the elastic element 42 is attached to the underside of base panel 21. The first elastic element 42 is connected to the actuating element 41. Furthermore, the first, elastic element 42 is a plate spring biased to hold the actuating element 41 in the first position P1. The first elastic element 42 is oriented along a central axis I between a front side FS and a rear side RS of the incineration toilet 100.

The actuating mechanism 40 further comprises an operating mechanism 46 in the form of an elongated sheet metal element 47. As shown in FIG. 6, the elongated sheet metal element 47 comprises a handle 48 in a first end. As shown in FIG. 3, the handle 48 is accessible through the closable access opening 121. The operating mechanism 46 comprises a second, elastic element 45 connected by means of cross members 44 to a second end of the elongated sheet metal element 47. The elongated metal element 47 is further provided with a bend 47*a* between its first and second ends. The operating mechanism 46 is partially inserted into the hollow space 26 below the base panel 21. The second, elastic element 45 is biased to push the first elastic element 42 upwardly when the operating mechanism 46 is inserted under the first, elastic element 42.

FIG. 7 and FIG. 8 show that the operating mechanism 46 is insertable into and retrievable from the underside of the first, elastic element 42, wherein the first elastic element 42 is forced upwardly when the operating mechanism 46 is inserted into the underside of the first, elastic element 42 and wherein the first elastic element 42 is allowed to retract downwardly when the operating mechanism 46 is retrieved from the underside of the first, elastic element 42.

The second, elastic element 45 is a plate spring, applying a constant upwardly directed force to the underside of the first, elastic element 42 and hence to the underside of the actuating element 41. The second, elastic element 45 has a spring constant larger than a spring constant of the first, elastic element 42, thus ensuring that the first elastic element is exerting a an upward force onto the actuating element 41 thus moving the actuating element 41 from position P1 to position P2 when the operating mechanism 46 is fully inserted.

Ash Tray

FIG. 1 shows that the downwardly facing surface of the ash tray 10 contains a central opening 12 adapted to receive the actuating element 41.

FIG. 5 illustrate how the ash tray 10 is movable in direction A or B when the closable access opening 121 is opened and while the actuating element 41 is in the first position P1. The ash tray 10 is movable out from A and into B along a central axis I between a front side FS and a rear side RS of the incineration toilet 100. The ash tray 10 is movable out from A and into B in a horizontal plane.

The ash tray 10 is locked in position within the toilet unit 110 by the actuating element 41 when the actuating element 41 is in the second position P2. When the ash tray is locked in position within the incineration toilet 100, movement of the ash tray 10 out from A the incineration toilet 100 is prevented.

Unlocking of, Removal of and Insertion of the Ash Tray

Figure 2:
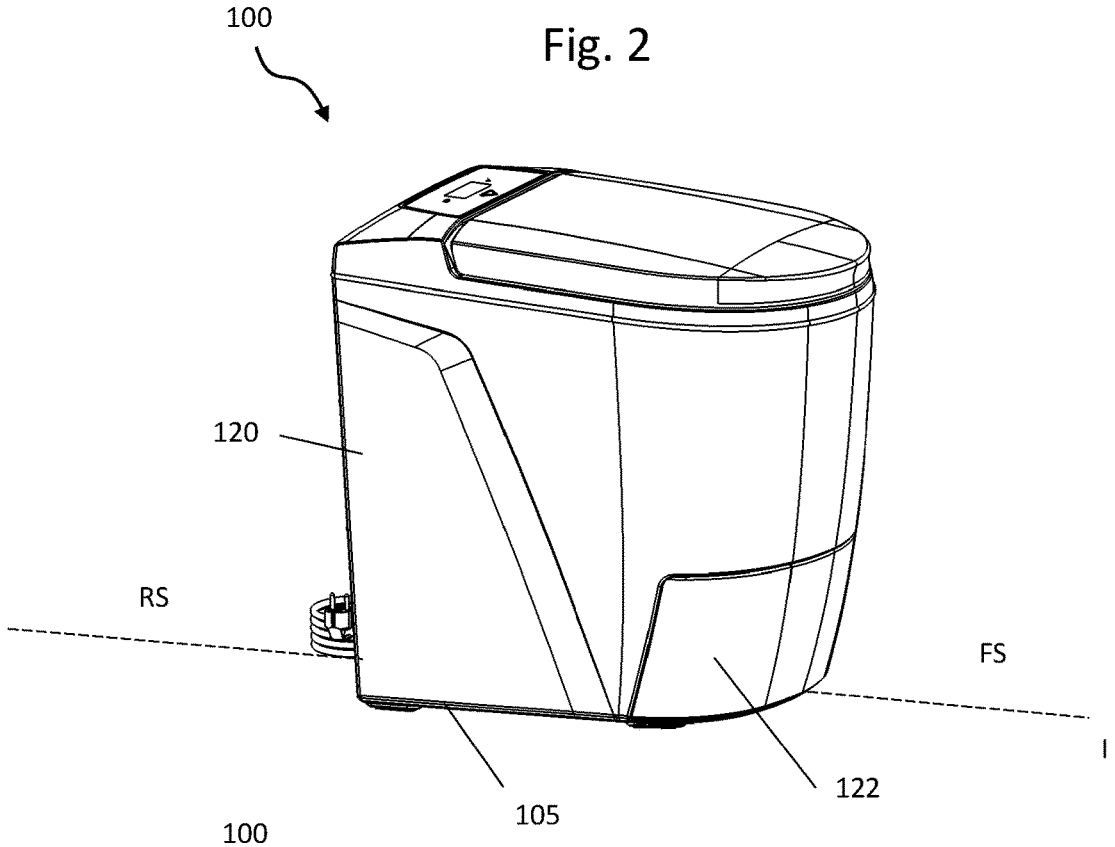
FIG. 2 shows a perspective view of the closed incineration toilet.

FIG. 2 shows the incineration toilet 100 with all openings closed and ready for use. To empty the ash tray, first the lid 122 of the closable access opening 121 is removed as shown in FIG. 3 giving access to handle 48. As shown in FIG. 4 and FIG. 9, the handle 48 is then used to withdraw the operating mechanism 46 thus moving actuating element 41 to position P1 thereby unlocking the ash tray 10. As shown in FIG. 5, the ash tray 10 may now be retrieved in direction A. As shown in FIG. 10, the bend 47*a* is causing the handle 48 to be elevated with respect to the floor.

Once ash tray 10 is emptied, it may be placed inside the incineration toilet 100 by moving it in direction B through the closable access opening 122 into the inside of the incineration toilet 100 as shown in FIG. 5. The handle 48 is then used to push the operating mechanism 46 inwards, moving the actuating element 41 into position P2 and thereby pushing the upper surface 11 of the ash tray 10 upwardly towards the lower surface 116*a* of the incineration chamber section 116. The ashtray 10 is now locked with respect to the incineration toilet. The lid 122 is then closed.

To ensure that the actuating element 41 is pushed far enough into the hollow space 26, the bend 47*a* may be pushed beyond a sheet metal fold 49, as shown in FIG. 8 and FIG. 10 thus providing the user with positive feedback.

The invention claimed is:

1. An incineration toilet comprising:

a base;

a toilet unit secured above the base, wherein the toilet unit comprises a toilet bowl, an incineration chamber formed by an upper incineration chamber section, and a removable ash tray positioned below the incineration chamber section; wherein a lower surface of the incineration chamber section is provided in contact with an upper surface of the ash tray during an incineration process;

a toilet casing connected to the base for protecting an outside of the toilet casing against heat from the incineration chamber;

wherein the incineration toilet comprises a closable access opening through which access is provided to the inside of the incineration toilet;

characterized in that the incineration toilet comprises an ash tray supporting assembly for supporting the ash tray relative to the base;

wherein the ash tray supporting assembly comprises:

an actuating element vertically movable between a first position and a second position, wherein the upper surface of the ash tray is pushed upwardly towards the lower surface of the incineration chamber section when the actuating element is in the second position, and wherein the ash tray supporting assembly comprises a guiding frame for positioning the ash tray above the actuating element, and wherein the actuating element is moving vertically through an aperture in the guiding frame between the first position and the second position.

2. The incineration toilet according to claim 1, wherein the ash tray is movable out through and in through the closable access opening while the actuating element is in the first position.

3. The incineration toilet according to claim 1, wherein the ash tray is locked in position within the toilet unit by the actuating element when the actuating element is in the second position.

4. The incineration toilet according to claim 1, wherein the ash tray supporting assembly comprises a first, elastic element for connecting the actuating element relative to the guiding frame.

5. The incineration toilet according to claim 4, wherein the first, elastic element is a plate spring biased to hold the actuating element in the first position.

6. The incineration toilet according to claim 4, wherein the ash tray supporting assembly comprises an operating mechanism insertable into and retrievable from the underside of the first, elastic element, wherein the first elastic element is forced upwardly when the operating mechanism is inserted into the underside of the first, elastic element and wherein the first elastic element is allowed to retract downwardly when the operating mechanism is retrieved from the underside of the first, elastic element.

7. The incineration toilet according to claim 6, wherein the operating mechanism comprises a handle in one end thereof.

8. The incineration toilet according to claim 6, wherein the operating mechanism comprises cross members and a second, elastic element biased to push the first elastic element upwardly when the operating mechanism is inserted into the underside of the first, elastic element.

9. The incineration toilet according to claim 8, wherein the second, elastic element has a spring constant larger than a spring constant of the first, elastic element.

10. The incineration toilet according to claim 1, wherein a downwardly facing surface of the ash tray comprises a central opening adapted to receive the actuating element.

11. The incineration toilet according to claim 1, wherein the actuating element is vertically movable a first distance between its first position and its second position, wherein the upper surface of the ash tray is pushed upwardly a second distance when the actuating element is in the second position, wherein the first distance is larger than the second distance.

* * * * *